US007100574B2

(12) United States Patent
Otani

(10) Patent No.: US 7,100,574 B2
(45) Date of Patent: Sep. 5, 2006

(54) COMMON RAIL TYPE FUEL INJECTION SYSTEM

(75) Inventor: Yusuke Otani, Chiryu (JP)

(73) Assignee: Denso Corporation, Kariya (JP)

( * ) Notice: Subject to any disclaimer, the term of this patent is extended or adjusted under 35 U.S.C. 154(b) by 46 days.

(21) Appl. No.: 11/059,638

(22) Filed: Feb. 17, 2005

(65) Prior Publication Data

US 2005/0183699 A1 Aug. 25, 2005

(30) Foreign Application Priority Data

Feb. 20, 2004 (JP) ..... 2004-044821

(51) Int. Cl.
*F02M 69/46* (2006.01)
*F02M 69/50* (2006.01)
*F02M 60/54* (2006.01)

(52) U.S. Cl. ..... 123/456; 123/198 D

(58) Field of Classification Search ..... 123/456, 123/198 D, 514, 512, 457, 446
See application file for complete search history.

(56) References Cited

U.S. PATENT DOCUMENTS 5,732,679 A * 3/1998 Takahasi et al. ..... 123/467
6,971,368 B1 * 12/2005 Uchiyama ..... 123/359
7,007,670 B1 * 3/2006 Okamoto et al. ..... 123/446
2003/0084871 A1 * 5/2003 Uchiyama et al. ..... 123/339.15
2003/0106531 A1 * 6/2003 Saeki et al. ..... 123/435
2003/0164161 A1 * 9/2003 Usui et al. ..... 123/510
2005/0126539 A1 * 6/2005 Okamoto ..... 123/446

FOREIGN PATENT DOCUMENTS

EP 1 319 821 6/2003

* cited by examiner

*Primary Examiner*—Mahmoud Gimie
(74) *Attorney, Agent, or Firm*—Nixon & Vanderhye P.C.

(57) ABSTRACT

If an inlet pressure of a supply pump sensed by an inlet pressure sensor is higher than a high-pressure side threshold value and an integrated period of the state exceeds a predetermined integration period, it is determined that a high pressure abnormality occurs, and processing for the high pressure abnormality is performed. Thus, failures of the supply pump due to the high pressure abnormality can be avoided. If the inlet pressure of the supply pump is lower than a low-pressure side threshold value and an integrated period of the state exceeds a predetermined integration period, it is determined that a low pressure abnormality occurs, and processing for the low pressure abnormality is performed. Thus, failures of the supply pump due to the low pressure abnormality can be avoided.

6 Claims, 4 Drawing Sheets

COMMON RAIL TYPE FUEL INJECTION SYSTEM

CROSS REFERENCE TO RELATED APPLICATION

This application is based on and incorporates herein by reference Japanese Patent Application No. 2004-44821 filed on Feb. 20, 2004.

BACKGROUND OF THE INVENTION

1. Field of the Invention

The present invention relates to a common rail type fuel injection system. Specifically, the present invention relates to a technology for detecting an abnormality in a pressure on an inlet side of a supply pump or an inlet side of a high-pressure pump included in the supply pump.

2. Description of the Related Art

A common rail type fuel injection system pressure-feeds fuel from a fuel tank into a common rail with the use of a supply pump and accumulates the fuel in the common rail. The system injects the fuel, which is accumulated in the common rail, from injectors.

The supply pump includes a high-pressure pump, which pressurizes the fuel to a high pressure and pressure-feeds the fuel, and a feed pump, which draws the fuel from an outside and feeds the fuel to the high-pressure fuel.

An assist pump for supplying the fuel to the supply pump is mounted in the common rail type fuel injection system if the fuel tank is disposed away from the supply pump or if a vertical interval between the fuel tank and the supply pump is large.

Usually, a fuel filter is disposed in a fuel supply pipe, through which the fuel is supplied from the fuel tank to the supply pump. Thus, the fuel flowing through the fuel supply pipe is filtered and supplied to the supply pump.

Conventionally, the common rail type fuel injection system is not equipped with means for sensing an inlet pressure, or a fuel pressure at an inlet of the supply pump or at an inlet of the high-pressure pump. Therefore, the inlet pressure of the supply pump or the high-pressure pump is not controlled.

Some abnormalities such as a high pressure abnormality or a low pressure abnormality can occur in the inlet pressure of the supply pump because of excessive pressure-feeding operation or defective pressure-feeding operation of the assist pump or clogging of the fuel filter.

Likewise, some abnormalities such as a high pressure abnormality or a low pressure abnormality can occur in the inlet pressure of the high-pressure pump because of defective pressure-feeding operation of the feed pump or a failure in a regulator valve.

If the high pressure abnormality occurs in the inlet pressure of the supply pump, the high pressure abnormality occurs in the supply pump. In such a case, there is a possibility that failures are caused in fuel sealing portions inside the supply pump or in fuel sealing portions of various parts downstream of the supply pump.

If the low pressure abnormality occurs in the inlet pressure of the supply pump, there is a possibility that cavities are generated inside the supply pump.

In order to perform injection control highly accurately, a common rail pressure has to be controlled highly accurately. Therefore, the inlet pressure of the supply pump, which affects the common rail pressure, has to be limited within a narrow range and used.

SUMMARY OF THE INVENTION

It is therefore an object of the present invention to provide a common rail type fuel injection system capable of detecting occurrence of an abnormality in an inlet pressure of a supply pump or a high-pressure pump.

More specifically, it is an object of the present invention to protect a common rail type fuel injection system by detecting occurrence of an abnormality in an inlet pressure of a supply pump or a high-pressure pump and by taking a measure suited for the abnormality in the inlet pressure.

According to an aspect of the present invention, a common rail type fuel injection system senses an inlet pressure of a supply pump or a high-pressure pump included in the supply pump with the use of an inlet pressure sensor. The fuel injection system determines that an abnormality occurs if the inlet pressure sensed by the inlet pressure sensor is out of a predetermined range. Thus, the occurrence of the abnormality in the inlet pressure of the supply pump or the high-pressure pump can be detected.

By detecting the occurrence of the abnormality in the inlet pressure of the supply pump or the high-pressure pump in such a manner, a measure suited for the abnormality can be taken. By performing the measure suited for the abnormality in the inlet pressure, the common rail type fuel injection system can be protected.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENTS (First Embodiment)

Figure 1:
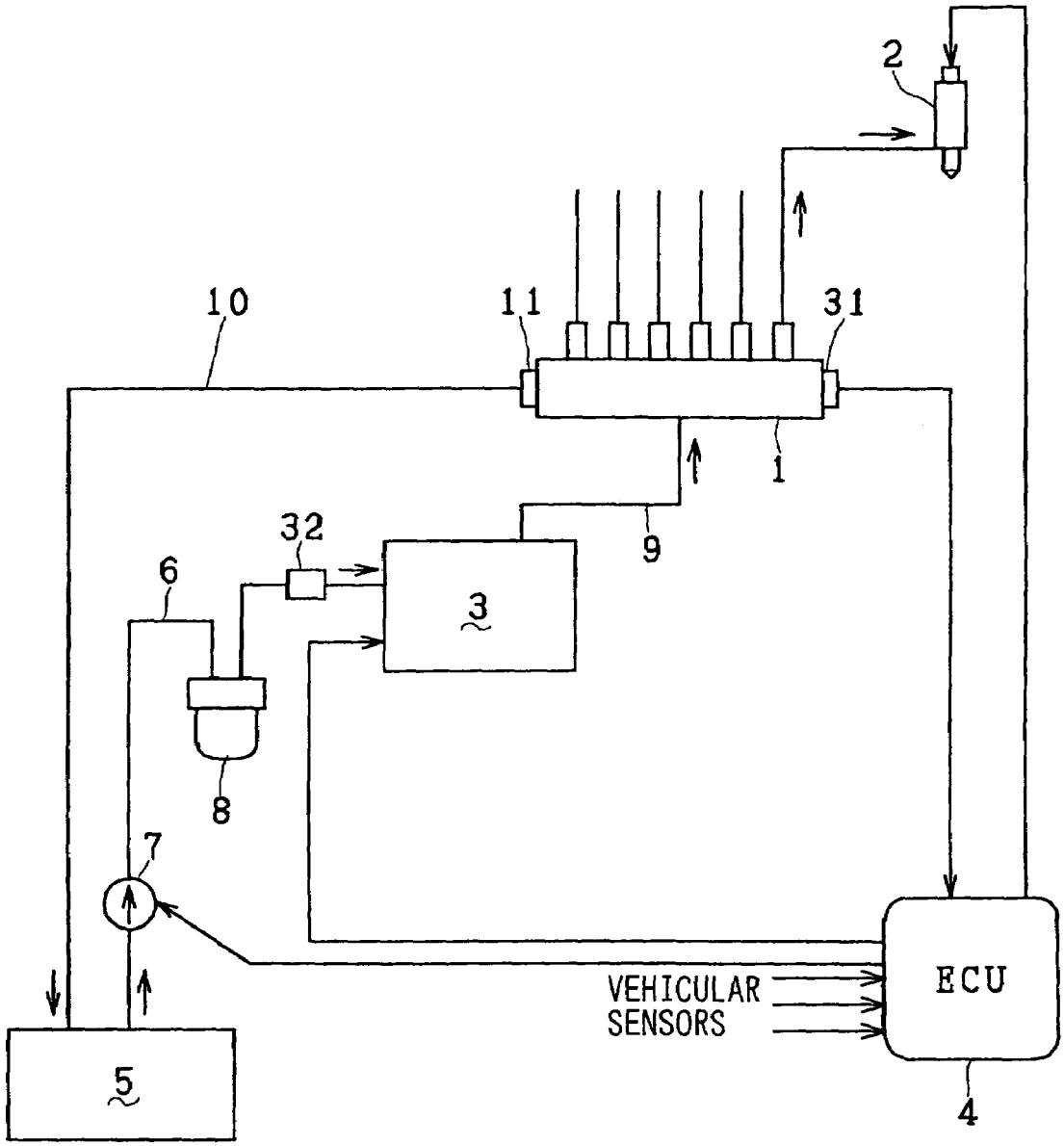
FIG. 1 is a schematic diagram showing a common rail type fuel injection system according to a first embodiment of the present invention.

Referring to FIG. 1, a common rail type fuel injection system according to a first embodiment of the present invention is illustrated.

The common rail type fuel injection system performs fuel injection into a diesel engine, for instance. The fuel injection system shown in FIG. 1 includes a common rail 1, injectors 2, a supply pump 3, an electronic control unit (ECU) 4, and the like.

The engine of the present embodiment is a nonroad engine, or an engine for a vehicle such as an agricultural vehicle, a construction vehicle or an industrial vehicle, which is not used regularly. Because of limited mountability of the supply pump 3 and a fuel tank 5, the supply pump 3 is disposed so that the supply pump 3 is away from the fuel tank 5 or a vertical interval therebetween is large (the supply pump 3 is mounted at a higher position than the fuel tank 5). Therefore, an assist pump 7 for drawing the fuel from the fuel tank 5 and for sending the fuel to the supply pump 3 is mounted in a fuel supply pipe 6, through which the fuel is supplied from the fuel tank 5 to the supply pump 3.

A fuel filter 8 for filtering the fuel flowing through the fuel supply pipe 6 is disposed in the fuel supply pipe 6. Thus, the fuel supplied to the supply pump 3 is purified.

The common rail 1 is an accumulation vessel for accumulating the high-pressure fuel, which is supplied to the injectors 2. The common rail 1 is connected to a discharge port of the supply pump 3, which discharges the high-pressure fuel, through a high-pressure fuel pipe 9. Thus, the common rail 1 can accumulate the fuel at a common rail pressure corresponding to a fuel injection pressure.

Leak fuel from the injectors 2 is returned to the fuel tank 5 through leak pipes (fuel return passages).

A pressure limiter 11 is mounted in a relief pipe (a fuel return passage) 10 leading from the common rail 1 to the fuel tank 5. The pressure limiter 11 opens if the fuel pressure inside the common rail 1 exceeds a limit set pressure. Thus, the pressure limiter 11 functions as a pressure safety valve for limiting the fuel pressure in the common rail 1 below the limit set pressure.

The injectors 2 are mounted to respective cylinders of the engine and inject the fuel into the respective cylinders. The injectors 2 are connected to downstream ends of branching pipes branching from the common rail 1. Each injector 2 includes a fuel injection nozzle, an electromagnetic valve and the like. The fuel injection nozzle injects the high-pressure fuel accumulated in the common rail 1 into each cylinder. The electromagnetic valve controls lifting movement of a needle accommodated in the fuel injection nozzle.

Figure 2:
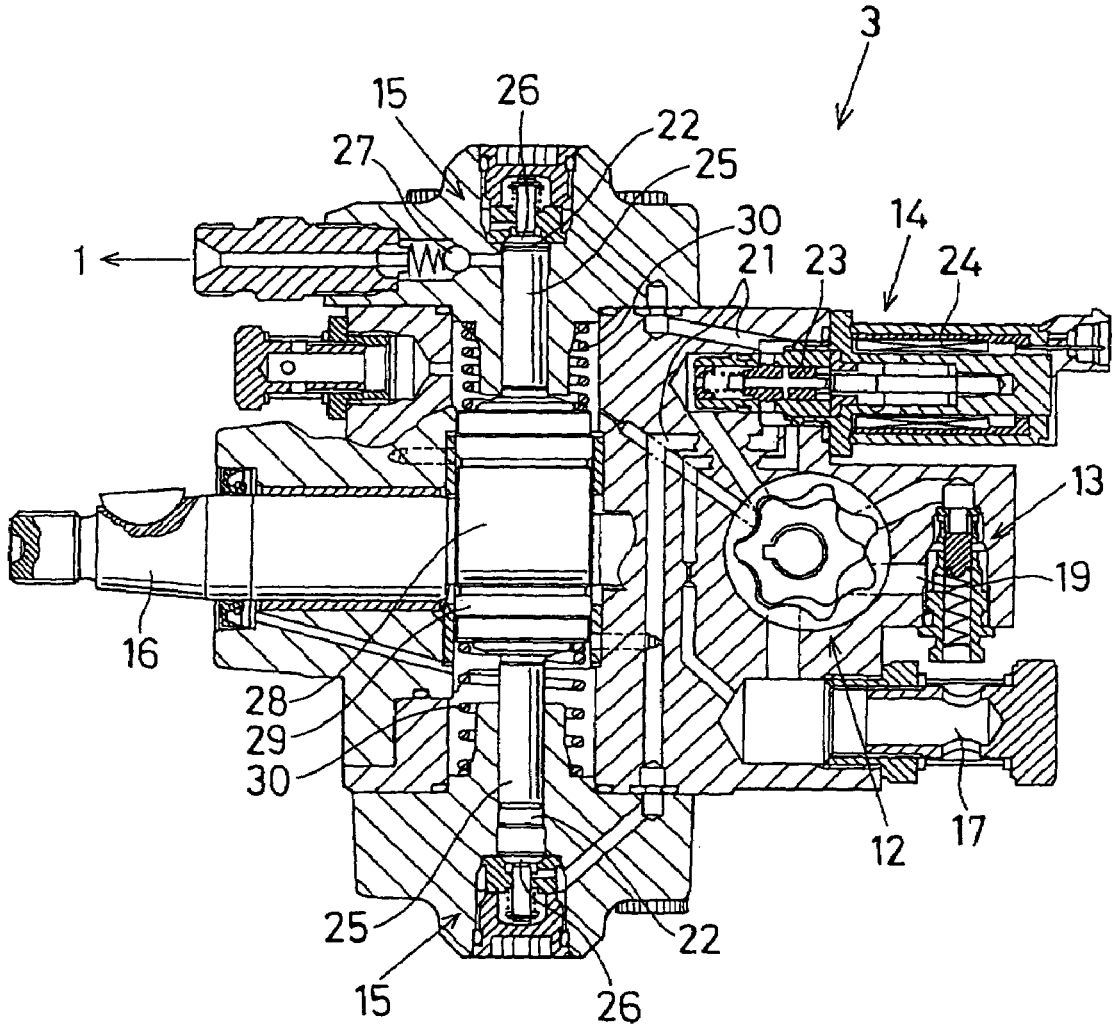
FIG. 2 is a sectional view showing a supply pump of the fuel injection system according to the first embodiment.

Next, an example of the supply pump 3 will be explained based on FIG. 2.

The supply pump 3 pressurizes the fuel to a high pressure and supplies the fuel to the common rail 1. The supply pump 3 includes a feed pump 12, a regulator valve 13, a fuel quantity regulation valve (a suction control valve: SCV) 14, and high-pressure pumps 15. In FIG. 2, the feed pump 12 is illustrated in a state in which the feed pump 12 is turned by an angle of 90°.

The feed pump 12 is a low-pressure feed pump for drawing the fuel supplied by the assist pump 7 and for supplying the fuel to the high-pressure pumps 15. If the feed pump 12 operates, a pressure on an inlet side of the feed pump 12 (or an inlet side of the supply pump 3) becomes a negative pressure in a predetermined pressure range during a normal operation. The feed pump 12 consists of a trochoid pump, which is rotated by a camshaft 16. If the camshaft 16 is driven, the feed pump 12 draws the fuel through a fuel inlet 17 and supplies the fuel to the high-pressure pumps 15 through the SCV 14.

In the present embodiment, the trochoid pump is employed as an example of the feed pump 12. Alternatively, any other types of low-pressure pump such as a vane pump may be employed as the feed pump 12.

The camshaft 16 is a pump drive shaft. The camshaft 16 is rotated by a crankshaft of the engine.

The regulator valve 13 is disposed in a fuel passage 19 connecting a discharge side and a supply side of the feed pump 12 with each other. If a discharge pressure of the feed pump 12 increases to a predetermined pressure, the regulator valve 13 opens to prevent the discharge pressure of the feed pump 12 from exceeding the predetermined pressure.

The SCV 14 is disposed in a fuel passage 21, through which the fuel is led from the feed pump 12 to the high-pressure pumps 15. The SCV 14 regulates a suction quantity of the fuel suctioned into pressurizing chambers (plunger chambers) 22 of the high-pressure pumps 15. Thus, the SCV 14 changes and regulates the common rail pressure.

The SCV 14 includes a valve 23 for changing an opening degree of the fuel passage 21, a linear solenoid 24 for regulating an opening degree of the valve 23 based on a driving current supplied by the ECU 4, and the like.

The high-pressure pumps 15 are plunger pumps for repeatedly performing suctioning operation and discharging operation of the fuel respectively in cycles, of which phases are deviated from each other by 180°. The high-pressure pumps 15 pressurize the fuel, which is supplied from the SCV 14, to a high pressure and supplies the fuel to the common rail 1. Each high-pressure pump 15 includes a plunger 25 reciprocated by the camshaft 16, a suction valve 26 for supplying the fuel into the pressurizing chamber 22, of which volume is changed by the reciprocation of the plunger 25, and a discharge valve 27 for discharging the fuel, which is compressed in the pressurizing chamber 22, to the common rail 1.

In the present embodiment, a cam ring 29 is fitted to a periphery of an eccentric cam 28 of the camshaft 16, and the plunger 25 is pressed against the cam ring 29 by a spring 30. If the camshaft 16 rotates, the plunger 25 reciprocates in accordance with eccentric movement of the cam ring 29.

If the plunger 25 descends and the pressure in the pressurizing chamber 22 decreases, the discharge valve 27 closes and the suction valve 26 opens. Thus, the fuel, of which quantity is regulated by the SCV 14, is supplied into the pressurizing chamber 22.

If the plunger 25 ascends and the pressure in the pressurizing chamber 22 increases, the suction valve 26 closes. Then, if the pressure of the fuel pressurized in the pressurizing chamber 22 reaches a predetermined pressure, the discharge valve 27 opens and the high-pressure fuel pressurized in the pressurizing chamber 22 is discharged to the common rail 1.

Any other types of high-compression pump may be employed as the high-pressure pump 15. For instance, a high-pressure pump, which is formed with a cam surface on an inner peripheral surface of a cam ring driven by the camshaft 16 so that a pair of plungers disposed opposite to each other are pressed against the cam surface and repeats suctioning operation and pressure-feeding operation of the fuel by increasing and decreasing a space between the pair of plungers, may be employed.

The ECU 4 has functions of CPU for performing control processing and arithmetic processing, a memory device (a memory such as ROM, standby RAM, EEPROM, or RAM) for storing various types of programs and data, an input circuit, an output circuit, a power source circuit, an injector drive circuit, a pump drive circuit and the like. The ECU 4 performs various types of the arithmetic processing based on sensor signals (engine parameters: signals corresponding to manipulating states of vehicle occupants, operating states of the engine, and the like) inputted to the ECU 4. Then, the ECU 4 controls and drives various electric functional parts such as the injectors 2 and the SCV 14.

The ECU 4 is connected with sensors such as an accelerator sensor for sensing an accelerator position, a rotation speed sensor for sensing an engine rotation speed, a water temperature sensor for sensing temperature of cooling water of the engine, an intake air temperature sensor for sensing temperature of intake air taken into the engine, fuel temperature sensor for sensing temperature of the fuel supplied to the injectors 2, a rail pressure sensor 31 for sensing the common rail pressure, and other sensors.

Next, characteristics of the present embodiment will be explained.

The common rail pressure accumulated in the common rail 1 has to be controlled highly accurately in order to control the injection highly accurately. Therefore, an inlet pressure, or a pressure at an inlet of the supply pump 3, which affects the common rail pressure, should be limited in a narrow range from −b (for instance, −30 Pa) to −a (for instance, −20 Pa) and used.

Conventionally, the common rail type fuel injection system is not equipped with means for sensing the inlet pressure of the supply pump 3. Therefore, the inlet pressure of the supply pump 3 is not controlled.

There is a possibility that some abnormalities such as a high pressure abnormality or a low pressure abnormality occur in the inlet pressure of the supply pump 3. If an abnormality of excessive discharge of the fuel occurs in the assist pump 7 and the high pressure abnormality occurs in the inlet pressure of the supply pump 3, the high pressure abnormality can occur in the supply pump 3 and failures of fuel sealing portions in the supply pump 3 or fuel sealing portions of various parts downstream of the supply pump 3 can occur.

If the low pressure abnormality in the inlet pressure of the supply pump 3 is caused by defective discharging operation of the assist pump 7 or clogging of the fuel filter 8, cavities can be generated in the supply pump 3.

Therefore, the fuel injection system of the present embodiment includes an inlet pressure sensor 32 for sensing the inlet pressure $\alpha$ of the supply pump 3 and determining means for determining that an abnormality occurs if the sensed inlet pressure $\alpha$ is out of a predetermined range. The inlet pressure sensor 32 of the present embodiment is disposed downstream of the assist pump 7 and the fuel filter 8 and upstream of the inlet of the supply pump 3 with respect to the flow direction of the fuel. The determining means is programmed in the ECU 4.

The determining means of the present embodiment determines that the high pressure abnormality occurs if the inlet pressure $\alpha$ (Pa) sensed by the inlet pressure sensor 32 is higher than a predetermined high-pressure side threshold value −a (Pa). The determining means determines that the low pressure abnormality occurs if the inlet pressure $\alpha$ sensed by the inlet pressure sensor 32 is lower than a predetermined low-pressure side threshold value −b (Pa).

Figure 3:
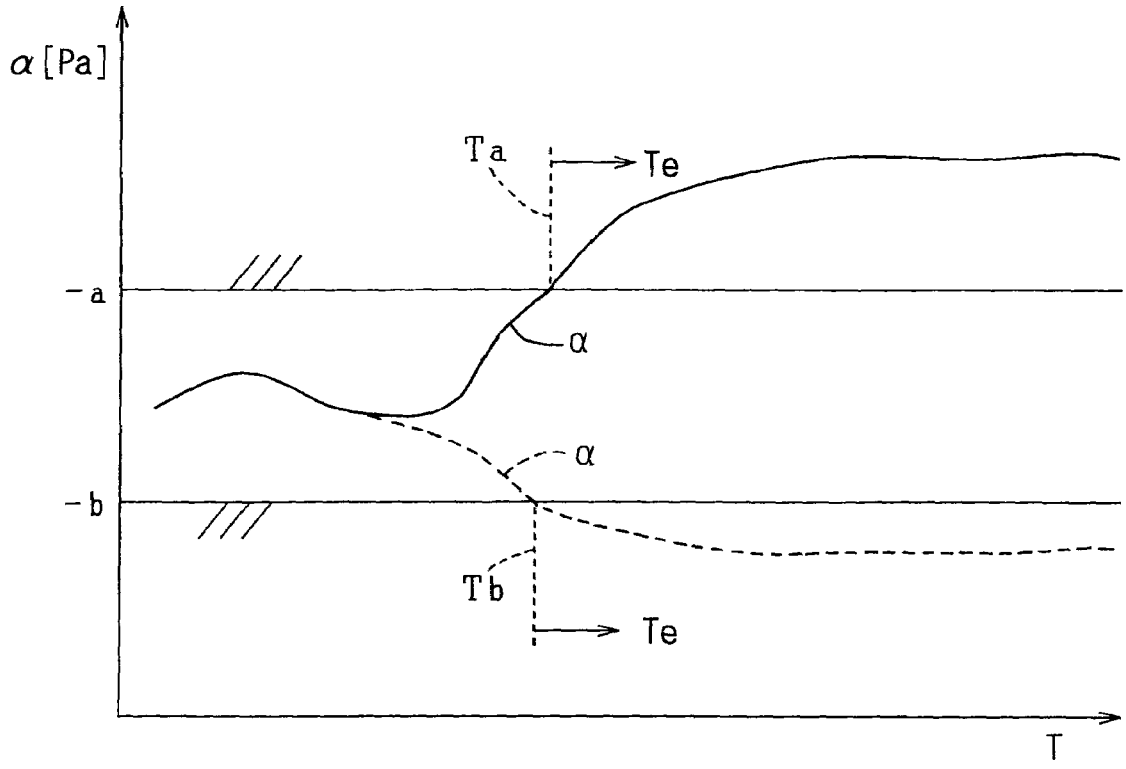
FIG. 3 is a time chart showing changes in an inlet pressure of the supply pump according to the first embodiment.

In order to prevent false detection, the determining means of the present embodiment starts counting at a time point Ta when the inlet pressure $\alpha$ sensed by the inlet pressure sensor 32 becomes higher than the predetermined high-pressure side threshold value −a as shown by a solid line $\alpha$ in FIG. 3. Thus, the determining means integrates a period Te in which the inlet pressure $\alpha$ is out of a predetermined range (a pressure range from −b to −a). If the integrated period Te exceeds a predetermined integration period (a threshold value) Tha, the determining means determines that the high pressure abnormality occurs. Likewise, in the determination of the low pressure abnormality, the determining means starts counting at a time point Tb when the inlet pressure $\alpha$ becomes lower than the low-pressure side threshold value −b as shown by a broken line $\alpha$ in FIG. 3. Thus, the determining means integrates a period Te in which the inlet pressure $\alpha$ is out of the predetermined range. If the integrated period Te exceeds a predetermined integration period (a threshold value) Thb, the determining means determines that the low pressure abnormality occurs.

If the inlet pressure $\alpha$ sensed by the inlet pressure sensor 32 returns into the predetermined range ($-b \leqq \alpha \leqq -a$) while the integrated period Te is counted, the count of the integrated period Te is reset.

A processing mode for avoiding malfunction due to the abnormality in the inlet pressure $\alpha$ when the abnormality in the inlet pressure $\alpha$ is detected is programmed in the ECU 4.

If the determining means determines that the high pressure abnormality occurs, operation in a high pressure abnormality processing mode is performed. In the high pressure abnormality processing mode, an escaping operation is performed to avoid a problem of occurrence of failures in the fuel sealing portions of the various parts due to the high pressure abnormality in the supply pump 3. In the escaping operation, the rotation of the camshaft is limited by reducing the rotation speed of the engine below a predetermined rotation speed, for instance. Alternatively, in the high pressure abnormality processing mode, the operation of the engine is stopped to prevent the occurrence of the failures of the various parts and the occurrence of the abnormality is indicated to the vehicle driver by displaying means such as a warning light. The warning light may indicate the occurrence of the abnormality in the fuel injection system. Alternatively, more specifically, the warning light may indicate the occurrence of the high pressure abnormality in the inlet pressure of the common rail 1.

If the determining means determines that the low pressure abnormality occurs, operation in a low pressure abnormality processing mode is performed. In the low pressure abnormality processing mode, the common rail pressure is decreased by controlling the opening degree of the SCV 14 to a small value in order to avoid a breakdown of the supply pump 3 due to the generation of the cavities in the supply pump 3. Meanwhile, in the low pressure abnormality processing mode, control for automatically decreasing the required injection quantity of the injector 2 is performed and the occurrence of the abnormality is indicated to the vehicle driver by the indicating means such as the warning light. The warning light may indicate the occurrence of the abnormality in the fuel injection system. Alternatively, more specifically, the warning light may indicate the occurrence of the low pressure abnormality in the inlet pressure of the common rail 1. Alternatively, the warning light may indicate the occurrence of the clogging of the fuel filter 8.

Figure 4:
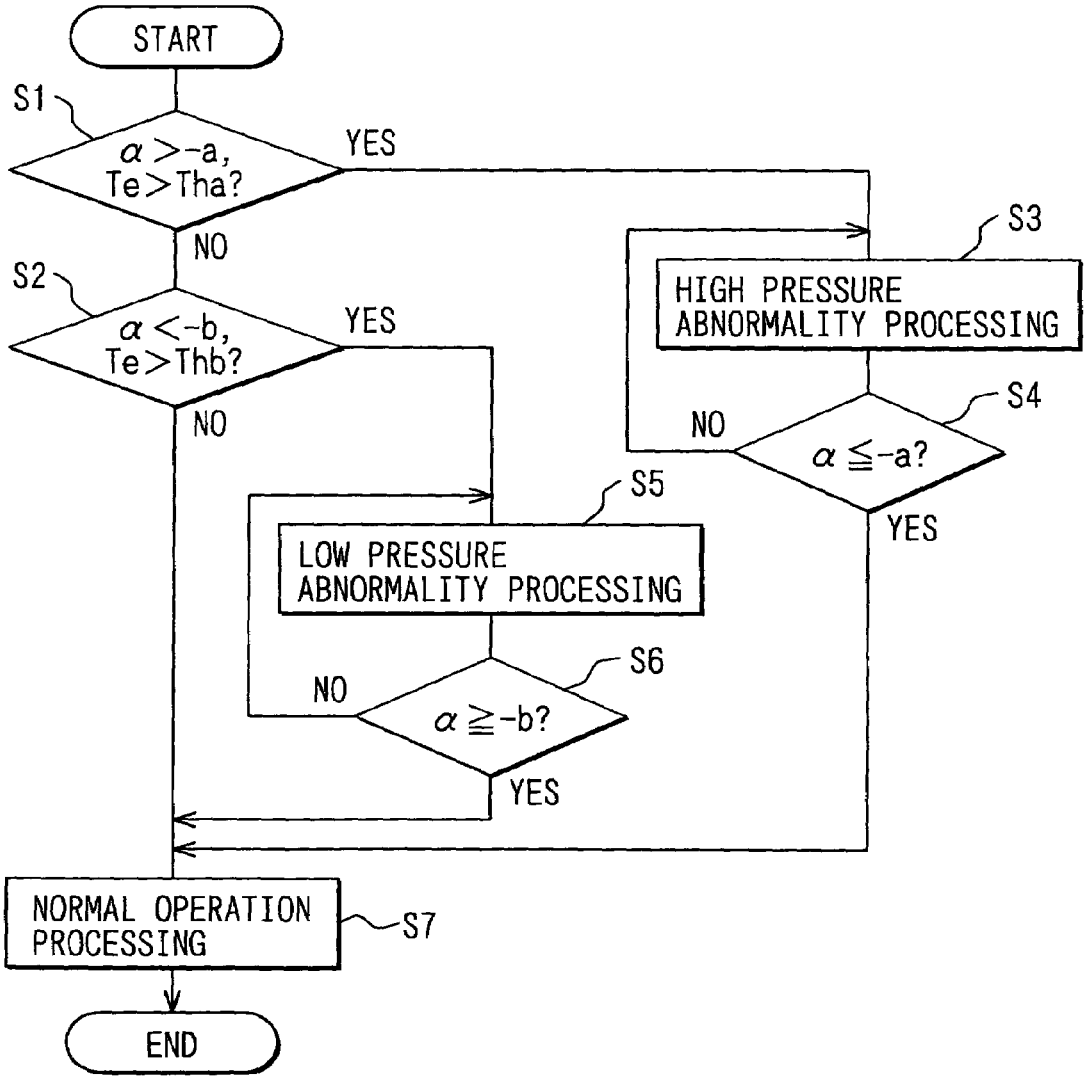
FIG. 4 is a flowchart showing steps of abnormality determination processing performed by an electronic control unit of the fuel injection system according to the first embodiment.

Next, the determination of the abnormality in the inlet pressure $\alpha$ of the supply pump 3 performed by the ECU 4 and the control of the processing performed by the ECU 4 after the determination of the abnormality will be explained based on a flowchart shown in FIG. 4.

First, in Step S1, it is determined whether the inlet pressure $\alpha$ sensed by the inlet pressure sensor 32 is a high pressure abnormal value (or whether the inlet pressure $\alpha$ is higher than the high-pressure side threshold value −a) and the integrated period Te of the state, in which the inlet pressure $\alpha$ is higher than the high-pressure side threshold value −a, is longer than the predetermined integration period (the threshold value) Tha.

If the result of the determination in Step S1 is "NO", it is determined whether the inlet pressure $\alpha$ sensed by the inlet pressure sensor 32 is a low pressure abnormal value (or whether the inlet pressure $\alpha$ is lower than the low-pressure side threshold value −b) and the integrated period Te of the state, in which the inlet pressure $\alpha$ is lower than the low-pressure side threshold value −b, is longer than the predetermined integration period (the threshold value) Thb in Step S2.

If the result of the determination in Step S1 is "YES", it is determined that the high pressure abnormality in the inlet pressure α occurs, and the operation in the high pressure abnormality processing mode is performed in Step S3.

Subsequently, in Step S4, it is determined whether the inlet pressure α sensed by the inlet pressure sensor 32 is "equal to or lower than" the high-pressure side threshold value −a. If the result of the determination in Step S4 is "NO", it is determined that the high pressure abnormality is continuing, and the ECU 4 returns to Step S3. If the result of the determination in Step S4 is "YES", the ECU 4 proceeds to Step S7.

If the result of the determination in Step S2 is "YES", it is determined that the low pressure abnormality in the inlet pressure α occurs, and the operation in the low pressure abnormality processing mode is performed in Step S5.

Subsequently, it is determined whether the inlet pressure α sensed by the inlet pressure sensor 32 is "equal to or higher than" the low-pressure side threshold value −b in Step S6. If the result of the determination in Step S6 is "NO", it is determined that the low pressure abnormality is continuing, and the ECU 4 returns to Step S5. If the result of the determination in Step S6 is "YES", the ECU 4 proceeds to Step S7.

If the results of the determination in Step S1 and Step S2 are "NO" or if the result of the determination in Step S4 or Step S6 is "YES", it is determined that the inlet pressure α is within a normal range ($-b \leqq \alpha \leqq -a$), and processing for normal operation is performed in Step S7.

Next, effects of the first embodiment will be explained.

The common rail type fuel injection system of the first embodiment senses the inlet pressure α of the supply pump 3 with the use of the inlet pressure sensor 32. The fuel injection system determines that the high pressure abnormality occurs if the inlet pressure α is higher than the high-pressure side threshold value −a and the integrated period Te of the state in which the inlet pressure α is higher than the high-pressure side threshold value −a exceeds the predetermined integration period Tha. Thus, the high pressure abnormality due to the excessive pressure-feeding operation of the assist pump 7 and the like can be detected.

By detecting the high pressure abnormality in such a manner, the problem of the occurrence of the high pressure abnormality in the supply pump 3 can be avoided. Thus, the problem of the occurrence of the failures in the fuel sealing portions in the supply pump 3 or in the fuel sealing portions downstream of the supply pump 3 due to the high pressure abnormality can be avoided.

The common rail type fuel injection system of the first embodiment determines that the low pressure abnormality occurs if the inlet pressure α sensed by the inlet pressure sensor 32 is lower than the predetermined low-pressure side threshold value −b and the integrated period Te of the state in which the inlet pressure α is lower than the low-pressure side threshold value −b exceeds the predetermined integration period Thb. Thus, the low pressure abnormality due to the clogging of the fuel filter 8 or the defective pressure-feeding operation of the assist pump 7 can be detected.

By detecting the low pressure abnormality in such a manner, the problem of the occurrence of the cavities in the supply pump 3 due to the low pressure abnormality can be avoided.

Moreover, the period Te of the state in which the inlet pressure α is out of the predetermined range (the range from −b to −a) is integrated since the inlet pressure α deviates from the predetermined range. It is determined that the abnormality occurs if the integrated period Te exceeds the predetermined integration period. Therefore, the problem of false detection of the abnormality in the inlet pressure α due to causes such as noise can be avoided. Thus, the reliability of the result of the determination of the determining means can be improved.

(Second Embodiment)

Next, a common rail type fuel injection system according to a second embodiment of the present invention will be explained.

In the common rail type fuel injection system of the second embodiment, the inlet pressure sensor 32 is disposed downstream of the feed pump 12 and upstream of the high-pressure pumps 15 with respect to the flow direction of the fuel. Thus, an inlet pressure α of the high-pressure pump 15 is sensed by the inlet pressure sensor 32.

By disposing the inlet pressure sensor 32 in such a way, the low pressure abnormality due to defective pressure-feeding operation of the feed pump 12 or fixation of the regulator valve 13 hindering the opening movement of the regulator valve 13 can be detected in addition to the low pressure abnormality due to the clogging of the fuel filter 8 and the defective pressure-feeding operation of the assist pump 7. Meanwhile, the high pressure abnormality due to the fixation of the regulator valve 13 hindering the closing movement of the regulator valve 13 can be detected in addition to the high pressure abnormality due to the excessive pressure-feeding operation of the assist pump 7.

The scheme of the second embodiment can also be applied to a common rail type fuel injection system employing no assist pump 7.

(Modifications)

In the first and second embodiments, the present invention is applied to the common rail type fuel injection system mounted to the nonroad engine (the engine of the vehicle, which is not used regularly). Alternatively, the present invention may be applied to a common rail type fuel injection system mounted to an engine of a regularly used vehicle, which can normally travel on general roads.

In the above embodiments, both of the high pressure abnormality and the low pressure abnormality are detected. Alternatively, either one of the high pressure abnormality and the low pressure abnormality may be detected and the control suitable for the abnormality may be performed when the abnormality is detected.

The present invention should not be limited to the disclosed embodiments, but may be implemented in many other ways without departing from the spirit of the invention.

What is claimed is:

1. A common rail type fuel injection system comprising:

a common rail for accumulating high-pressure fuel;

an injector for injecting the fuel accumulated in the common rail;

a supply pump for pressurizing the fuel and for supplying the fuel to the common rail;

an inlet pressure sensor for sensing a pressure at an inlet of the supply pump or at an inlet of a high-pressure pump included in the supply pump; and determining means for determining that an abnormality occurs if the pressure sensed by the inlet pressure sensor is out of a predetermined range.

2. The fuel injection system as in claim 1, wherein the determining means determines that a high pressure abnormality occurs if the pressure sensed by the inlet pressure sensor is higher than a predetermined high-pressure side threshold value.

3. The fuel injection system as in claim 1, wherein the determining means determines that a low pressure abnormality occurs if the pressure sensed by the inlet pressure sensor is lower than a predetermined low-pressure side threshold value.

4. The fuel injection system as in claim 1, wherein the determining means integrates a period, in which the pressure sensed by the inlet pressure sensor is out of the predetermined range, since the pressure deviates from the predetermined range, and determines that the abnormality occurs if the integrated period exceeds a predetermined integration period.

5. The fuel injection system as in claim 1, further comprising:

a feed pump included in the supply pump for preliminarily pressure-feeding the fuel to the high-pressure pump of the supply pump;

an assist pump for drawing the fuel from a fuel tank and for supplying the fuel to the supply pump, the assist pump being disposed in a fuel supply pipe through which the fuel is supplied from the fuel tank to the supply pump; and a fuel filter disposed in the fuel supply pipe for filtering the fuel flowing through the fuel supply pipe, wherein the inlet pressure sensor is disposed downstream of the assist pump and the fuel filter and upstream of the supply pump with respect to a flow direction of the fuel.

6. The fuel injection system as in claim 1, further comprising:

a feed pump included in the supply pump for preliminarily pressure-feeding the fuel from a fuel tank to the high-pressure pump; and a fuel filter disposed in a fuel supply pipe, through which the fuel is supplied from the fuel tank to the supply pump, for filtering the fuel flowing through the fuel supply pipe, wherein the inlet pressure sensor is disposed downstream of the feed pump and upstream of the high-pressure pump with respect to a flow direction of the fuel.

* * * * *